United States Patent [19]

Preston, Jr. et al.

[11] 4,307,781

[45] Dec. 29, 1981

[54] CONSTANTLY ENERGIZED NO-LOAD TENSION PACKER

[75] Inventors: Dan C. Preston, Jr., Whittier; Kenneth C. Reiter, Long Beach, both of Calif.

[73] Assignee: Baker International Corporation, Orange, Calif.

[21] Appl. No.: 109,698

[22] Filed: Jan. 4, 1980

[51] Int. Cl.[3] ..... E21B 33/128; E21B 33/129

[52] U.S. Cl. ..... 166/123; 166/182

[58] Field of Search ..... 166/123, 125, 136, 137, 166/182, 214, 215

[56] References Cited

U.S. PATENT DOCUMENTS

| | | | |
|---|---|---|---|
| 2,122,749 | 7/1938 | Morrisett | 166/240 |
| 2,290,142 | 7/1942 | Burt | 166/137 |
| 3,256,437 | 6/1966 | Muse | 166/139 |
| 4,018,274 | 4/1977 | Cochran | 166/182 |
| 4,071,084 | 1/1978 | Brown et al. | 166/182 |
| 4,176,715 | 12/1979 | Bigelow | 166/140 |
| 4,216,827 | 8/1980 | Crowe | 166/182 |

*Primary Examiner*—James A. Leppink

*Attorney, Agent, or Firm*—William C. Norvell, Jr.

[57] ABSTRACT

A retrievable, constantly energized, no-load packer is securable within a well and removable by application of tension. Upper and lower slip means are expandable into gripping engagement with the casing. A control body extends to the upper and lower slips and is encircled by packing means. A release housing extends from the lower expansion means with latch means being provided for securing the control body with the release housing, the latch means being shiftable to disengage the control body from the release housing for retrieval of the apparatus. Lock sleeve means are connected to the release housing for securing the latch means and one of the control body and release housing and are shearably releasable therefrom for disengagement of the control body and the release housing, the application of tension through the control string being carried by the control body without being transmitted through the lock sleeve means to set the apparatus. A tubular member securable to the running string is telescopically manipulatable within the body of the apparatus to provide a conventional slick joint upon selective release from the body of the apparatus. Effective pressure area means are provided for transmitting to the packer means a compressive force resulting from a differential pressure from above or below across the packing means when the slip means are in expanded position and the packing means are sealed relative to the casing whereby the packing means are constantly energized and maintained in sealed relation with the casing.

17 Claims, 14 Drawing Figures

CONSTANTLY ENERGIZED NO-LOAD TENSION PACKER

BACKGROUND OF THE INVENTION

1. Field of the Invention

The invention relates to a packer apparatus for use in subterranean oil and gas wells.

2. Description of the Prior Art

Well bore packers are frequently utilized in well casings, with a tubular string of running and retrieving pipe or tubing associated with the packer and held in tension during setting and retrieval. In environments where there may be considerable temperature variations, causing expansion and contraction of the tubing conduit, there may be loss of integrity of setting and sealing elements of various down hole tools.

In U.S. Pat. No. 3,256,437, issued June 14, 1966, entitled "High Temperature Well Packer Apparatus", there is disclosed a packer apparatus which is particularly adapted for use in high temperature well bores, where temperatures are from between about 400° F., up to and sometimes exceeding 700° F. A feature of that prior art packer which enables its use in high temperature wells is that a sealed tubing member or "slick" joint extends through the body of the packer and can be released from the body to allow the tubing to be "spaced out", with the slick joint thereafter being free to allow for expansion and contraction of the tubing string. The packing and slick joint seal can be periodically retightened to prevent leakage, and the packer assembly is retrievable.

In U.S. patent application Ser. No. 863,871, filed Dec. 23, 1977, Eugene H. Bigelow, et al, inventors, entitled "High Temperature Well Packer", an improved apparatus combines the features of the aforesaid patent which is set in the well casing and retrieved therefrom by taking a pull on the tubing string, but without requiring rotation of the tubing string except to release a control device when the packer is initially set in the well bore and to release a connection between the packer body and the tubing to allow the tubing to be spaced out.

The present invention provides an improvement over each of the above prior art devices. The present apparatus provides means for anchoring the apparatus onto the interior wall of the casing to prevent both upward and downward longitudinal movement within the well. Additionally, means are provided to continuously energize the packing assembly as a result of differential pressure being transferred in the tool and applied thereacross. Furthermore, the present apparatus energizes the packing assembly without applying a load across critical components of releasing means utilized to disengage the slick joint from the interior of the packer body.

SUMMARY OF THE INVENTION

The present invention is directed to a retrievable, constantly energized, no-load packer apparatus which is adapted for use in a subterranean oil or gas well within a first conduit, such as casing, and connectable to a second conduit, such as a running or work string, for running and setting of the apparatus within the well. The apparatus basically comprises an elongated body having defined therearound a resiliently deformable packing which is sealable with the first conduit in response to longitudinal manipulation of the body of the apparatus by application of tension through the work or running string. Upper and lower sets of normally retracted but expandable slip means may be shifted into gripping engagement with the casing to place the apparatus into anchored position at a predetermined depth within the well. Companion upper and lower expansion means are provided for expanding the slip means and are carried above and below the packing means. A control body operably extends to the upper and lower slip and expander means and is encircled by the packing means. A release housing extends from the lower expansion means and is secured with the control body by latch means during running and setting of the apparatus. The latch means are selectively shiftable to disengage the control body and the release housing for retrieval of the apparatus. Lock sleeve means are provided which are connected to the release housing for securing the latch means and one of the control body and the release housing, and shearably releasable therefrom for disengagement of the control body and the release housing. Application of tension through the running or work string is carried by the control body without being transmitted through the lock sleeve means to shift the upper and lower slip means into anchored position and drive the packing means into sealing relation with the first conduit. A tubular member is securable to the work string for telescopic manipulation relative to the elongated body, and is releasable therefrom to define a conventional slick joint for spacing out of the running or work string and to compensate for expansion and contraction of the tubing due to temperature variables. Differential pressure acting on the apparatus resulting from increased pressures either above or below the apparatus are transmitted through the apparatus to the packing element to maintain the packing element in continuous sealed relation with the casing, thereby maintaining the packer element in a constantly energized state.

DESCRIPTION OF THE PREFERRED EMBODIMENTS

Figure 1A:
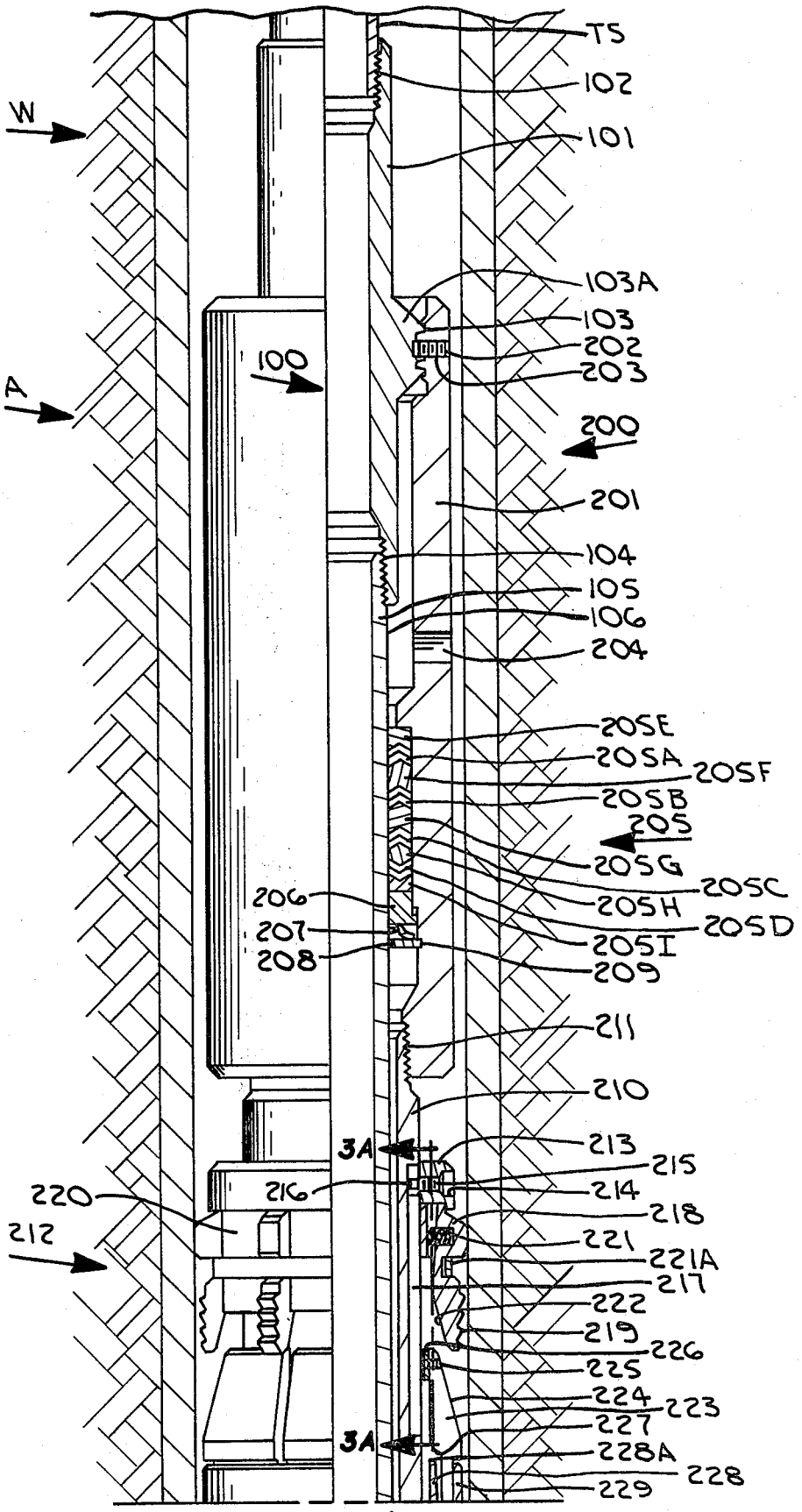
FIGS. 1A, 1B and 1C together constitute a longitudinally extending sectional view of the apparatus of the present invention run into a well through casing, the view being taken prior to activation of the apparatus for anchoring and sealing engagement.
Figure 1B:
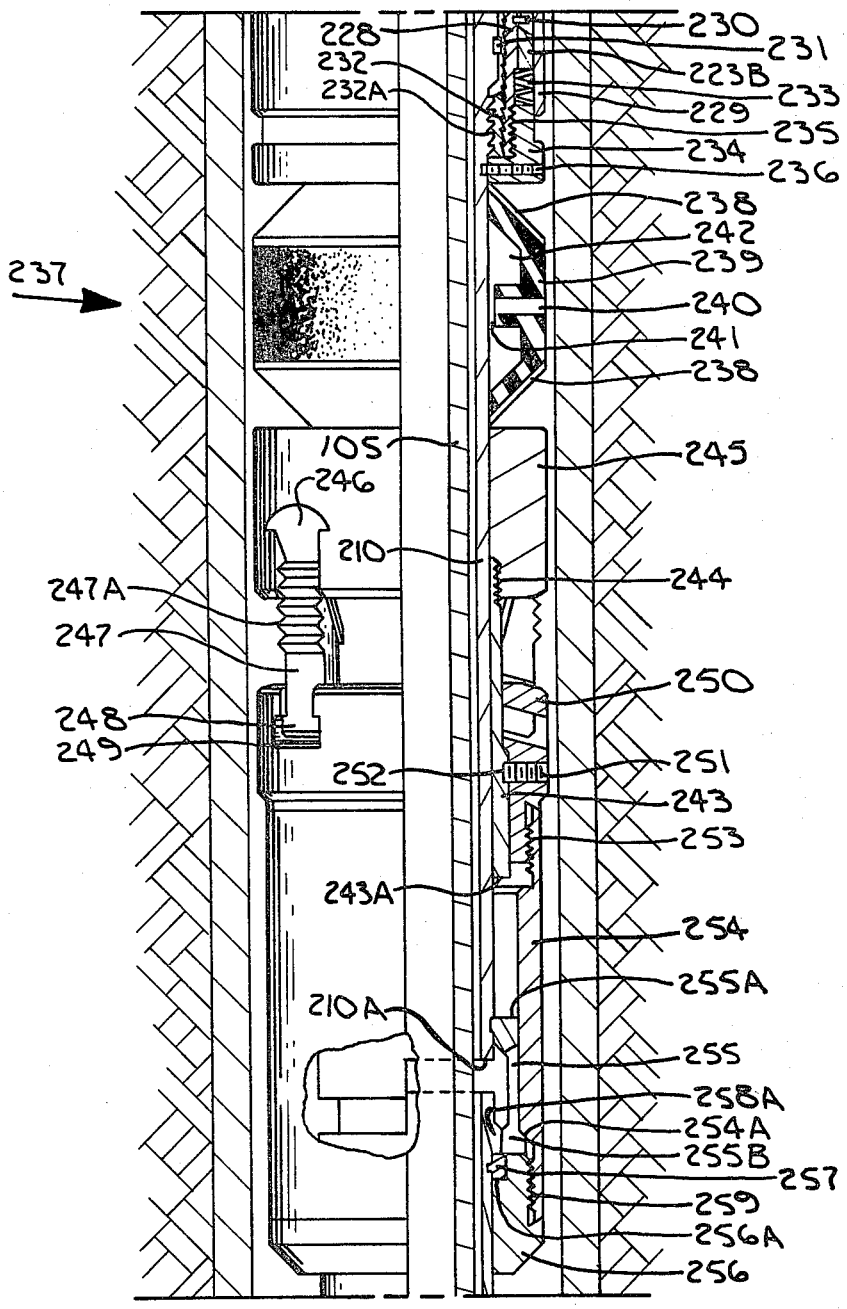
Figure 1C:
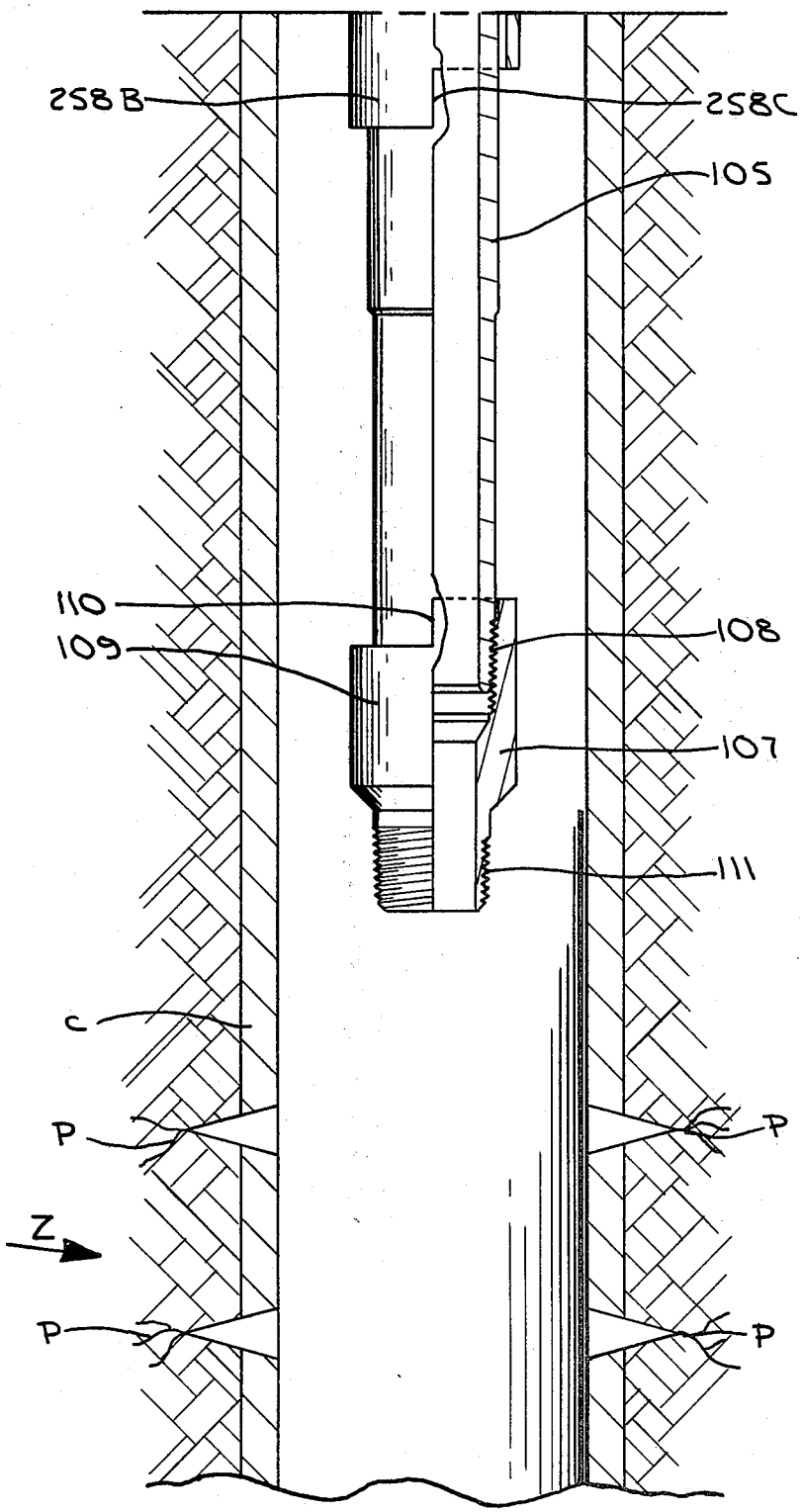

Now referring to FIGS. 1A, 1B, 1C, 3A and 3B, the apparatus A is shown affixed to the lowermost end of a tubing string TS extending within the well W, interior of the casing C, the casing C having a series of circumferentially extending perforations P bored therethrough for communication to a production zone Z. Generally, it will be desirable to set the apparatus A somewhat above the zone Z.

The apparatus A consists of a cylindrical packer assembly 200 which receives a slick joint 100 interiorly thereof. Initially, the slick joint 100 is secured against longitudinal movement relative to the packer assembly 200, but is permitted to selectively telescope with respect to the packer assembly 200, and is completely removable therefrom, subsequent to the setting of the packer assembly 200 in the well W.

The slick joint 100 is defined at its uppermost end by means of a top sub 101 having thread members 102 at its uppermost end for affixation to the lowermost end of the tubing string TS. Left-hand modified acme threads 103 are defined on an abutment 103A on the tob sub 101 for initial affixation to a longitudinally extending seal housing 201 defined exteriorly therearound. The threads 104 secure the top sub 101 to an elongated slick joint member 105 having a smooth exterior surface 106 for sealing engagement with the interior of a chevron seal assembly 205. The slick joint 105 continues downwardly within the interior of the packer assembly 200 and receives at its lowermost end a bottom clutch member 107 at left-hand emergency release threads 108. The bottom clutch member has threads 111 which may be utilized to affix additional length of conduit or other well tool (not shown).

The bottom clutch member 107 has a lower clutch profile 109 defined at its uppermost end with a clutch 110 thereon for selective co-engagement with the clutch 258C on the upper clutch profile 258B of the packer assembly 200 during normal and emergency release operations.

A seal housing 201 defines the uppermost end of the packer assembly 200, the top sub 101 of the slick joint 100 being secured to the seal housing 201 by means of threads 103 and secured against rotational movement by use of a transverse shear pin 202 received within a bore 203. A venting passageway 204 within the seal housing 201 permits pressure equalization across the apparatus A above a seal assembly 205, also carried within the seal housing 201.

The seal assembly 205 basically is chevron-shaped in construction, and prevents fluid communication therebelow to thereabove in an annular area between the packer assembly 200 and the slick joint 100, as the slick joint 105 is manipulated longitudinally relative to the packer assembly 200 subsequent to setting in the well W. The seal assembly 205 has a plurality of seal members 205A, 205B, 205C and 205D, with respective spacers 205E, 205F, 205G, 205H and 205I therebetween. A seal retainer 206 is carried on the seal housing 201 at the lowermost end of the assembly 205 and has a lower face receiving the uppermost end of a circumferentially extending wave spring element 207 which maintains pressure on the seal assembly 205 for energizing the seals therein. A spring retaining ring 208 receives the lowermost end of the spring 207, the ring 208 being secured within a groove 209 in the seal housing 201.

The packer assembly 200 continues lowerly of the seal housing 201 by means of a body member 210 affixed to the seal housing 201 at threads 211. The body 210 carries an upper slip assembly 212 generally defined by a series of circumferentially extending spaced slip elements 218 and companion upper cones 223 for riding up against the interior of the slips to urge them outwardly and into anchoring engagement with the interior of the casing C.

Figure 3A:
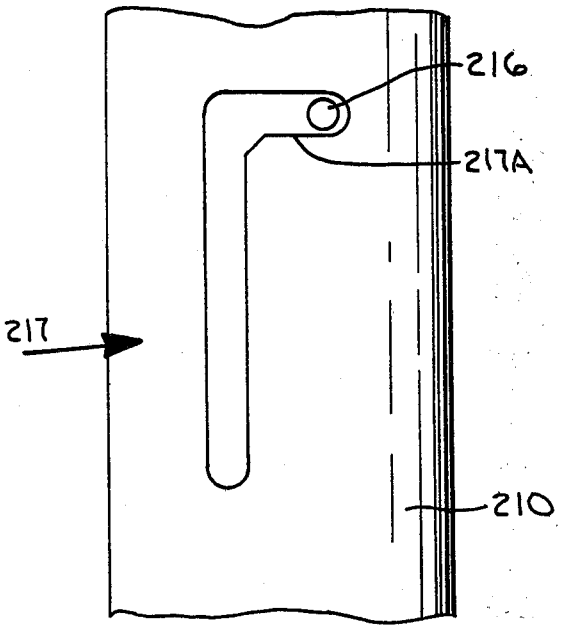
FIG. 3A is a cross-sectional view taken along Line 3A—3A of FIG. 1A, illustrating the relative position between the control pin and the J-slot, as the apparatus is being run within the well to the desired setting location.
Figure 3B:
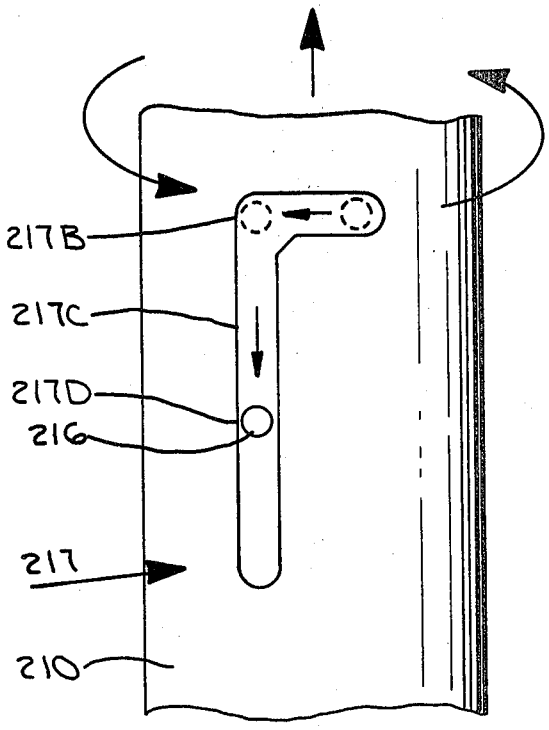
FIG. 3B is a view similar to that of FIG. 3A, and is taken along Line 3B—3B of FIG. 2A, illustrating the relative movement between the control pin and the J-slot during and subsequent to setting of the apparatus.
Figure 4A:
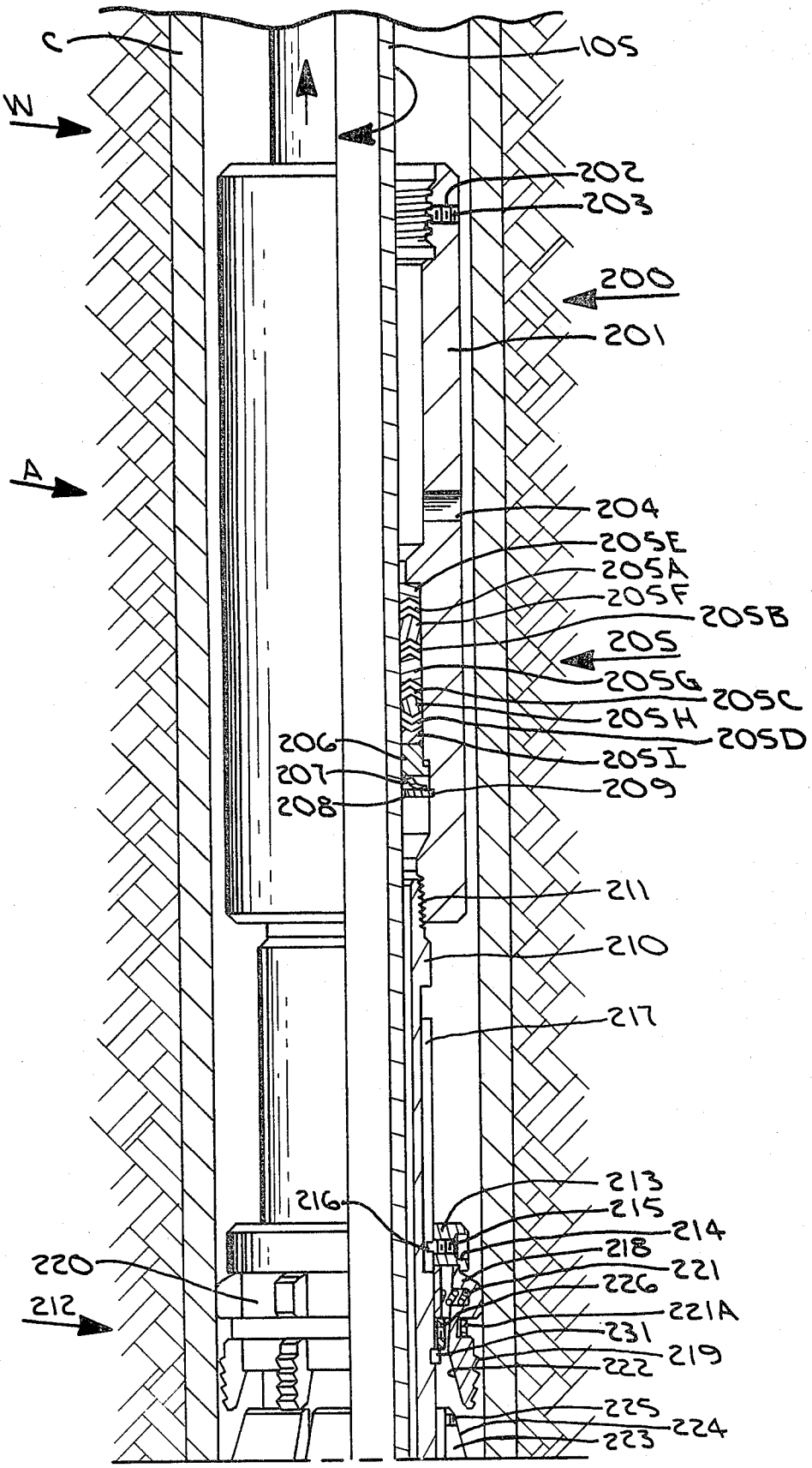
FIGS. 4A, 4B and 4C together constitute a longitudinally extending sectional view of the apparatus during the retrieval procedure.
Figure 4B:
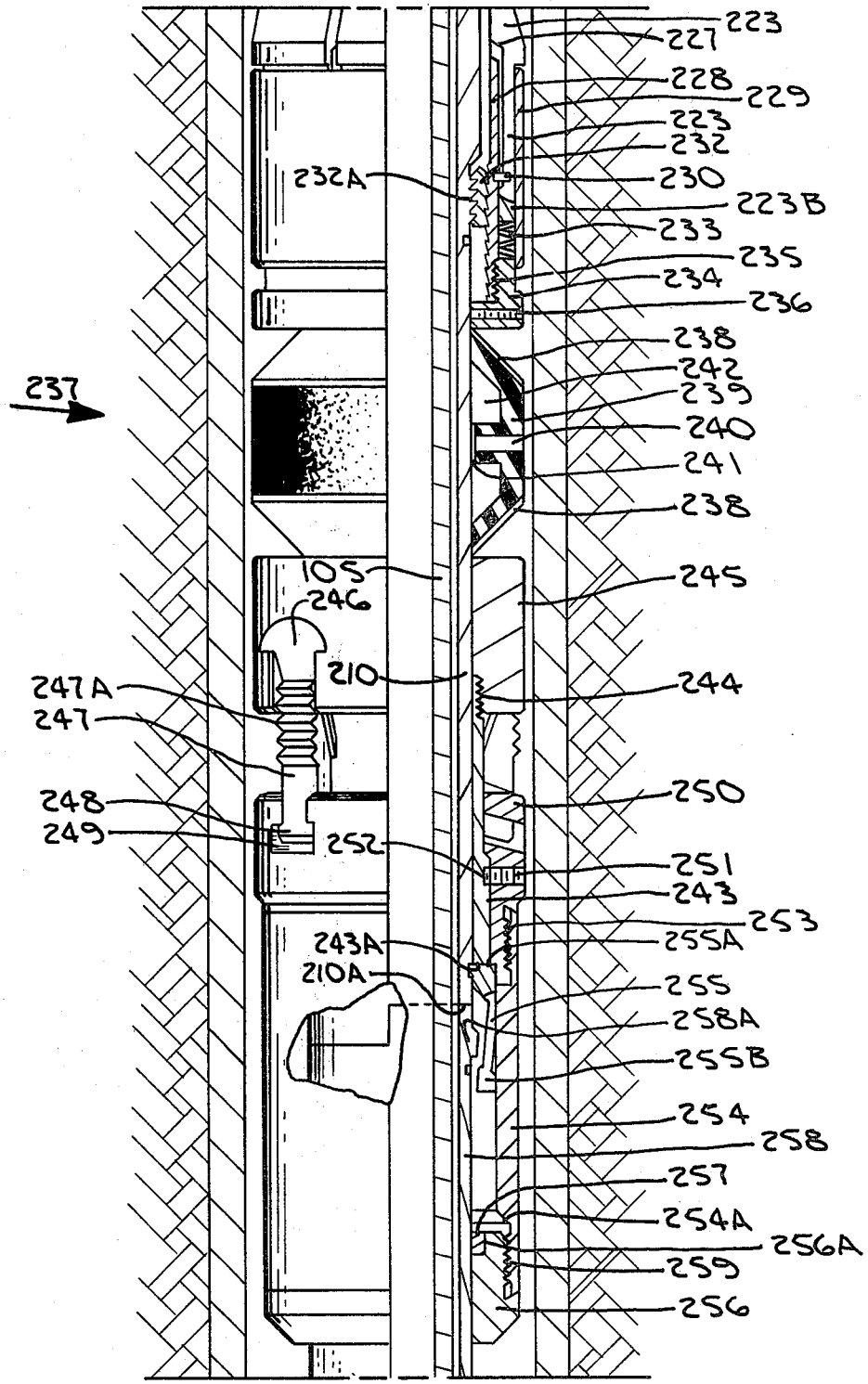
Figure 4C:
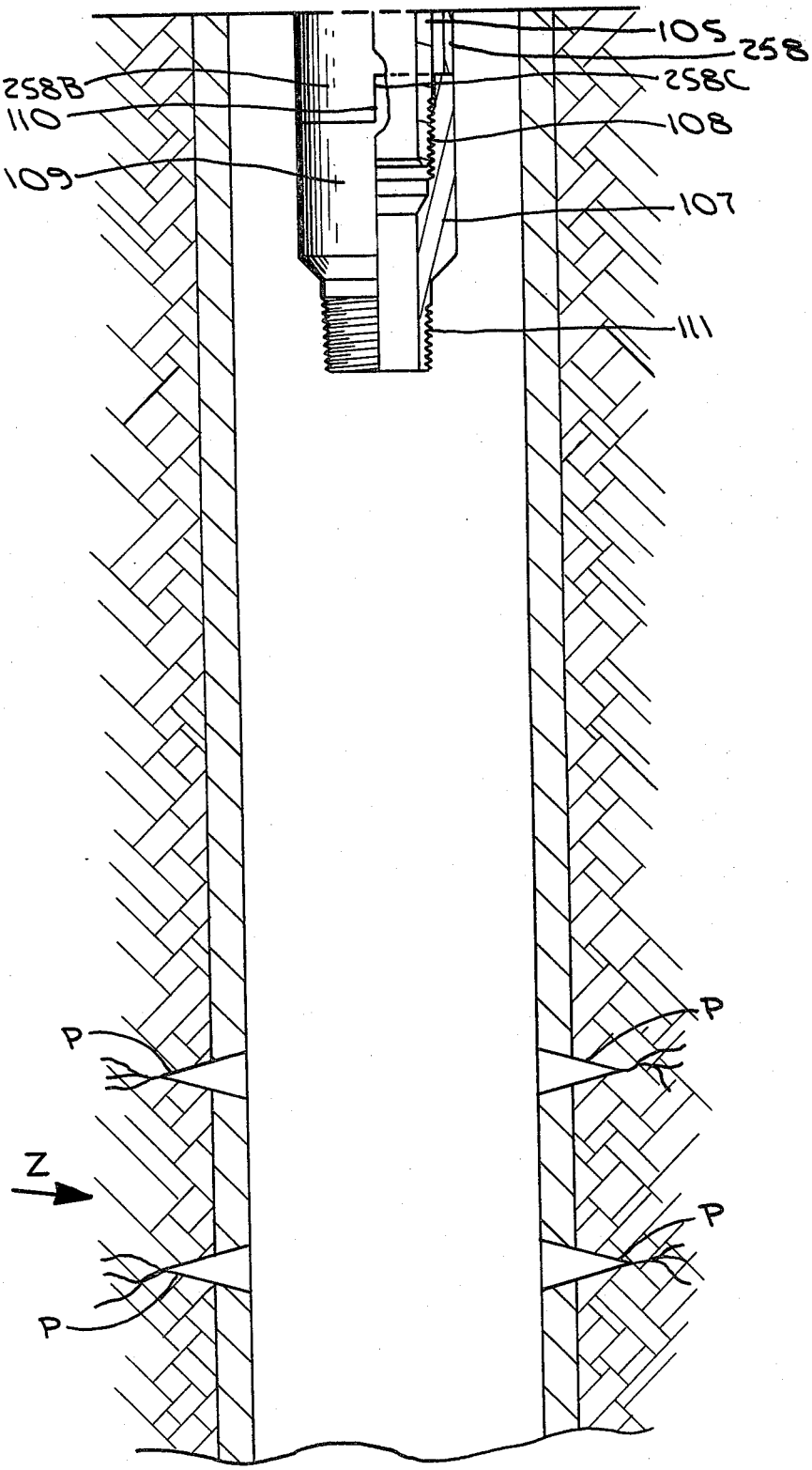

The upper slip assembly 212 has a slip stop ring 213 at its uppermost end for receiving within a transverse bore 214 a J or control pin element 215 having its interior end 216 received within a J-slot configuration 217 on the body 210 (FIGS. 3A and 3B). The J-slot 217 receives the end 216 of the control pin 215 with relative movement between the slot 217 and the pin 215 occurring during manipulation of the apparatus A during the setting and retrieval procedures.

The J-slot 217 has a running slot 217A at its uppermost end with a terminal position 217B for receipt of the end 216 of the control pin 215 as it is being manipulated within the slot 217 to guide the pin 216 into a longitudinally extending setting leg 217C communicating with the running slot 217A, until the end 216 of the pin 215 is in the set position 217D, when the apparatus A is set within the well W.

The series of circumferentially extending spaced slip elements 218 have their uppermost end received within the slip stop ring 213. Each slip member 218 has a series of saw-like configured teeth elements 219 protruding exteriorly to grasp the inner wall of the casing C for effective anchoring of the apparatus A within the well W. The slips 218 also are secured by means of a slip ring 220 carried interior of the slips 218 to prevent collapse of the slips 218 during rocking motion as the apparatus A is set in the well W. A spring 221 is housed within each slip 218 to urge the slips 218 outwardly and away from the slip ring 220 such that the outermost diameter surface of each slip 218 will travel along the inner diameter of the casing C as the apparatus A is manipulated downwardly within the well W to act as a "drag" against longitudinal movement for proper setting of the slip assembly 212. A slip retaining ring 221A is contoured around the exterior of the entire slip assembly 212 to maintain each slip in aligned position.

A downwardly sloped profile or bevel 222 is configured on the interior of each slip 218 for companion receipt of a similarly profiled guide 224 on each of the upper cones 223. As the guide 224 and profiles 222 come into contact, upward motion carried through the cones 223 is transmitted to the slips 218 to urge them outwardly and into anchored engagement with the inner wall of the casing C.

Each cone 223 is secured to a cone support ring 226 carried circumferentially around the uppermost end of the guide element 224 by means of a shear pin 225 which is sheared during release of the apparatus A for retrieval to the top of the well W. Prior to setting, the cone support ring 226 prevents the cones 223 from collapsing inwardly.

Each cone 223 has a contoured downwardly facing shoulder 227 for selective interengagement with the upper end 228A of a lock ring retainer 228 therebelow. Finally, a cone retaining sleeve 229 is carried exteriorly around the upper cones 223. The cones 223 have their lowermost end secured to a cone body member 223B, being secured thereto by means of a stop pin element 230. A pickup ring 231 is carried circumferentially around the exterior of the body 210 which is functional during retrieval of the apparatus A from the well W to catch the cone support ring 226 for shearing of the pin 225, thereby permitting the cones 223 to collapse inwardly.

A body lock ring 232 is secured by means of threads 232A to the body 210 to permit ratcheting by means of outwardly extending wicker elements thereon with companion wicker elements on the lock ring retainer 228 to trap pack-off force and travel of the body 210 into the packing assembly 237.

A series of stacked belleville springs 233 are housed between the cone body member 223B and the upper gauge ring 234 therebelow to energize the upper cone members 223 to drive the members 223 under the slips 218. The gauge ring 234 is secured by threads 235 to the lock ring retainer 228. A series of shear screw members 236 are housed within the upper gauge ring 234 to prevent pre-setting of the apparatus A, but shear during the setting operation.

The packing assembly 237 generally consists of a non-elastomeric packing means, the non-elastomeric nature of the assembly 237 being preferred because of the high temperature operating characteristics of the apparatus A within the well W. The packing assembly 237 consists of upper and lower anti-extrusion metallic ring members 238 bridging a non-elastomeric packing element 239, of known construction. A well fluid flow path 240 is defined interior of the packing element 239 with a longitudinally extending passage member 241 being provided for communication with the flow path 240 and the hollow interior 242 of the packing element 239 to permit pressure equalization and to permit fluid to enter the packing element 239 to increase its efficiency.

A limit sleeve 243 slidably affixes lower cone members 245 to a slip ring element 250 therebelow. The sleeve 243 is secured by threads 244 to the lower cones 245. Each cone 245 has a profiled ramp 246 for sliding receipt of a series of lower slip elements 247 having outwardly facing teeth elements 247A thereon to grasp the inner wall of the casing C. Each slip 247 has a "T" configured member 248 received within a companion "T" slot 249 defined within the slip ring 250. The slip ring 250 is secured to the limit sleeve 243 by means of shear pins 251 received within a groove 252 bored within the limit sleeve 243, which prevent inadvertent activation of the lower slip assembly, the shear pins 251 shearing during the setting procedure. The limit sleeve 243 has a lowerly facing end 243A which defines the upper limit of travel of the releasing latch 255, and interfaces with the upper end 255A of the latch 255.

Threads 253 secure the lowermost end of the slip ring 250 to a longitudinally extending release latch housing 254. The housing 254 has a critical shoulder 245A profiled thereon for initial interface with a companion profiled collet upper shoulder 255B on a releasing latch 255 carried interiorly of the release latch housing 254. The release latch housing 254 is secured by means of threads 259 to a shear ring retainer element 256 at its lowermost end, the shear ring retainer 256 having an upwardly defined groove 256A for receipt of a shear ring 257 thereon, the ring 257 initially securing an elongate shear ring sleeve 258 having an abutment 258A extending exteriorly around its uppermost end for interface with the collet finger portion of the releasing latch 255.

The shear ring sleeve 258 also has a clutch profile 258B at its lowermost end with a clutch member 258C thereon interfacing, selectively, with a companion clutch profile 110 on the lower clutch element 109 during reciprocation of the slick joint assembly 100 to release the slick joint from within the packer assembly 200.

It should be noted that the body 210 is operably secured relative to the upper slip assembly 212 through the body lock ring 232, as well as to the lower slip assembly through the releasing latch 255, the latch 255 being interengaged between the release latch housing 254 and the shear ring sleeve 258. Now, because the body 210 also is secured to the seal housing 201 which, in turn, initially is secured by the thread 103 and through the shear pin 202 to the top sub 101 of the slick joint assembly 100, longitudinal manipulation of the tubing string TS in one direction will be transmitted through the packer assembly 200 to each of the upper and lower slip assemblies.

Figure 2A:
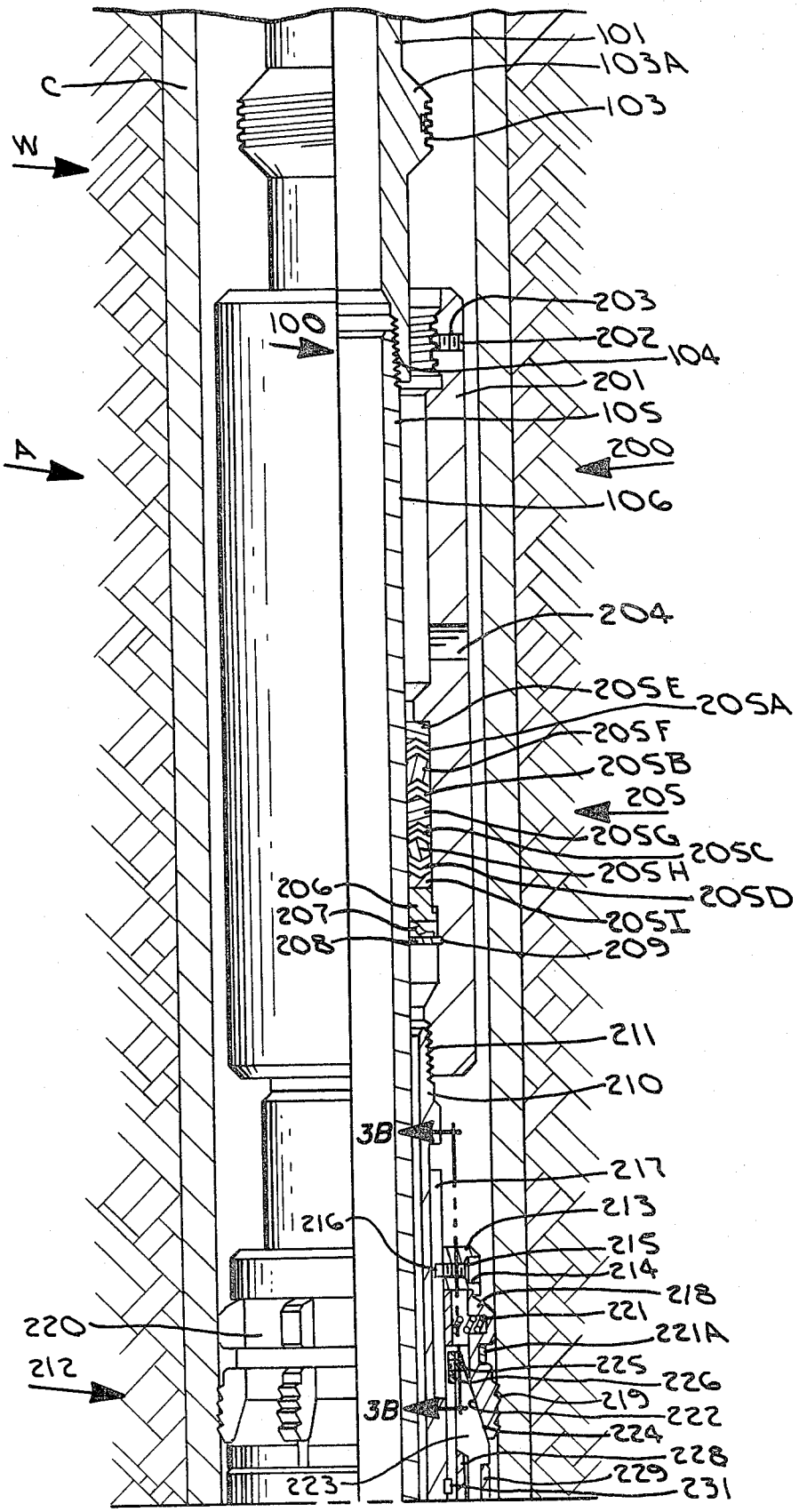
FIGS. 2A, 2B and 2C are views respectively corresponding to FIGS. 1A, 1B and 1C, illustrating the position of the component parts of the apparatus subsequent to the setting of the apparatus in the well and subsequent to release of the slick joint from the body of the packer assembly for spacing out of the tubing conduit.
Figure 2B:
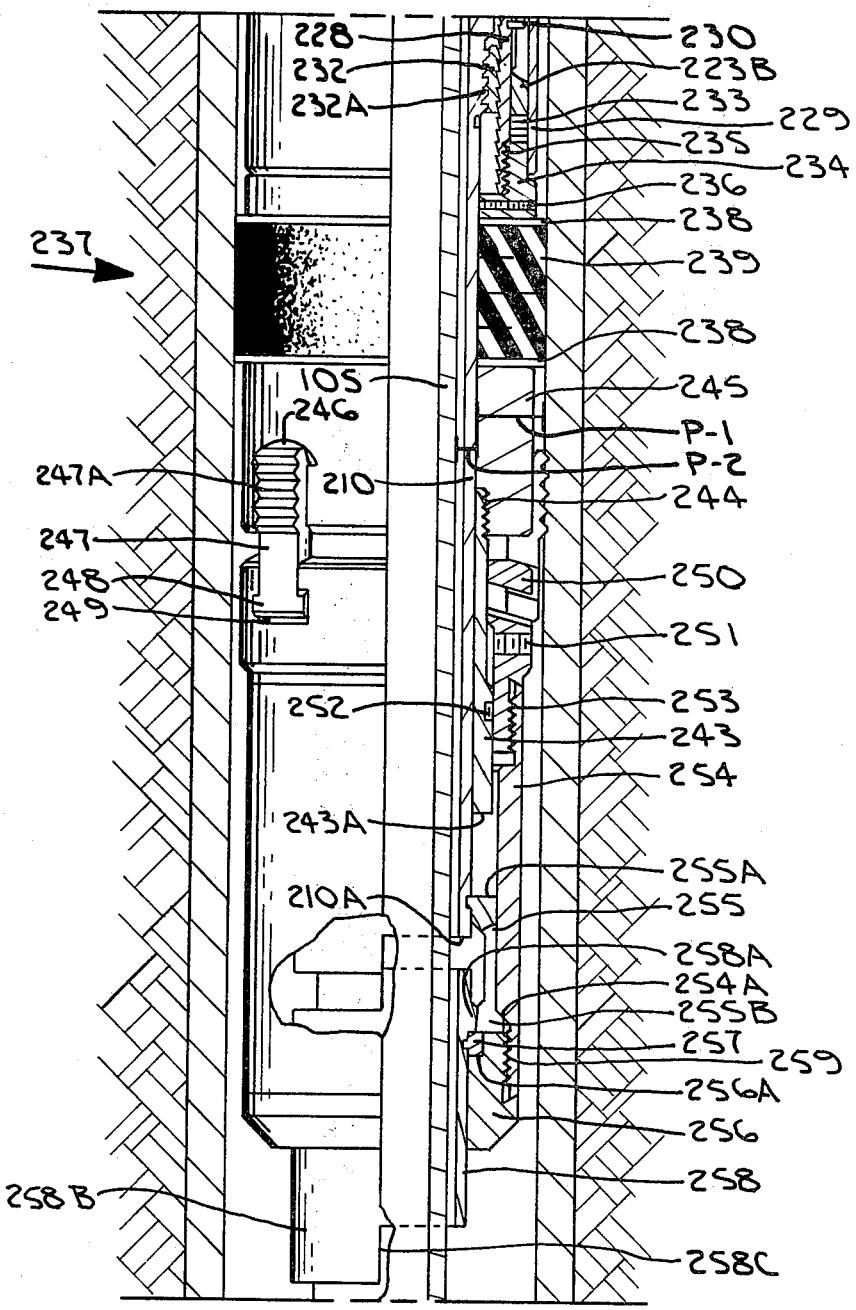

As shown in FIG. 2B, it should also be noted that there is an effective differential pressure area P-2 defined across the apparatus A as the outer diameter of the slick joint 105 immediate the packing assembly 237 and the internal diameter of the packer element 239. Additionally, another effective differential pressure area is defined across the apparatus A, subsequent to setting, and is identified as P-1; that is, the internal diameter of the casing C to the internal diameter of the packing element 239.

OPERATION

SETTING OF APPARATUS

Referring first to FIGS. 1A, 1B, 1C, 3A and 3B, the apparatus A is affixed to the lower end of a tubing string TS which, in turn, is lowered into the well W through the casing C, and just slightly below the desired setting depth, somewhat above the top of the zone Z. It should be noted that as the apparatus A travels longitudinally downwardly within the well W, the exterior drag pad portion of the rocker slips 218 will be urged outwardly toward the inner wall of the casing C by means of the force defined through the springs 221, such that a resulting drag against downward movement is afforded, the interface between the wall of the casing C and the exterior of the slips 218 resisting, but not preventing, downward longitudinal movement of the apparatus A. During travel of the apparatus A within the well W, the end 216 of the J-pin 215 is positioned on the running slot 217A of the J-slot 217.

At a predeterminable depth, immediately somewhat above the top of the zone Z, the tubing string TS is rotated in a first direction, preferably to the left, to permit the pin end 216 to travel relatively within the J-slot 217 from the running slot position 217A to the terminal 217B. Now, the pin 215 and the J-slot 217 may be relatively shifted longitudinally. To effect such longitudinal relative movement, the tubing string TS is picked up, whereby the end 216 of the pin 215 is shifted into the setting leg 217C of the J-slot 217. The "drag" afforded by the interface of the slips 218 to the inner wall of the casing C permits relative longitudinal movement between the upper slip assembly 212 and the body 210. As the upper pulling force is transmitted to the upper cone 223, the contoured guide surface 224 of each of the upper cones 223 shoulders against the companion profile 222 of the upper slips 218, and the interface of the surfaces 222–224 causes the slips 218 into a rocking motion and urges the teeth 219 outwardly into anchoring engagement within the inner wall of the casing C. As the upward pulling forces defined through the tubing string TS continues, it is transmitted through the lock ring retainer 228 to urge the upper end 228A of the retainer 228 into contact with the companion shoulder 227 of the upper cones 223, thus compressing the belleville springs 233 against the gauge ring 234 to transmit additional anchoring load onto the cones 223.

As the upward pulling motion defined through the tubing string TS is transmitted from the upper cone 223 to the slips 218, the shear strength of the shear screws 236 housed between the upper gauge ring 234 and the body 210 will be overcome, and the shear screws 236 will break. Now, the body lock ring 232 ratchets on the threads on the lock ring retainer 228, thus transmitting the upward pulling force through the upper gauge ring 234 causing relative downward motion thereof onto the packing assembly 237, while the body 210 moves upwardly.

During the setting of the upper slip assembly 212, as described above, it should be noted that the cone support ring 226 is held in place interiorly of the upper cones 223 by means of the shear pin 225, to prevent inward collapse of the cones 223.

As the body 210 continues to move upwardly relative to the packing assembly 237, upper gauge ring 234, etc., the upward pulling force is transmitted to the lower slip assembly by means of the interconnection between the body 210 and the releasing latch 255. It should be noted that the releasing latch 255 is, in turn, secured to the release latch housing 254 by the interface between the latch housing shoulder 254A and the collet shoulder 255B, with the abutment 258A on the shear ring sleeve 258 urging the releasing latch 255 into engagement between the shoulders 254A–255B.

As the upper pulling force is transmitted through the releasing latch 255 and the release latch housing 254 to the lower slip ring 250, this force is transmitted to the packing assembly 237 through the lower cone 245, to deform and urge the packing assembly 237 into sealed relation with the inner wall of the casing C. Concurrently, the shear strength of the shear pin 251 interconnecting the lower slip ring 250 with the limit sleeve 243, is overcome, and the pins 251 will shear, thus disengaging the lower slip ring 250 from the limit sleeve 243. Now, the lower slips 247 may be urged upwardly along the ramps 246 of the lower cones 245 to urge the teeth 247A outwardly and into grasping engagement with the inner wall of the casing C. Continued upward pulling on the tubing strings TS now is transmitted through the lower slips 247, into the lower cone 245, thence into the packing assembly 237, which, in turn, is being deformed and squeezed by means of the downward force applied thereon through the upper gauge ring 234.

Although the upward pulling force is transmitted from the body 210 to the lower slip assembly through the releasing latch 255, the shear ring 257 is not loaded by such pulling force, the releasing latch 255 carrying the entire upward pulling load from the body 210 to the release latch housing 254. Such an arrangement eliminates the possibility of inadvertent shearing of the shear ring 257, which would result in a premature activation of the retrieving mechanism, thus preventing effective setting of the apparatus A.

After the apparatus A has been properly set within the well W into anchoring and sealing relation with the inner wall of the casing C, the upward tension applied through the tubing string TS may be relieved.

In order to space out the tubing string TS and to provide a conventional slick joint for such spacing out operation and to otherwise compensate for expansion and contraction effects upon the tubing string TS during steam injection operations, or the like, within the well W, the tubing string TS is rotated in a second direction, preferably to the right, to shear the shear pin 202 holding the top sub 101 of the slick joint assembly 100 in rotational alignment with the seal housing 201 of the packer assembly 200, permitting the separation of the slick joint assembly 100 from the packer assembly 200 as the modified acme threads 103 are disengaged. Resistance to rotation of the packer assembly 200 with the slick joint assembly 100 is afforded by the anchoring of the packer assembly 200 onto the wall of the casing C by means of the upper and lower slip assemblies. When the top sub 101 is completely separated from the seal housing 201, the slick joint 105 may be manipulated longitudinally together with the tubing string TS without longitudinal movement of the packer assembly 200. The slick joint assembly 100 now may be utilized as a conventional slick joint.

Figure 2C:
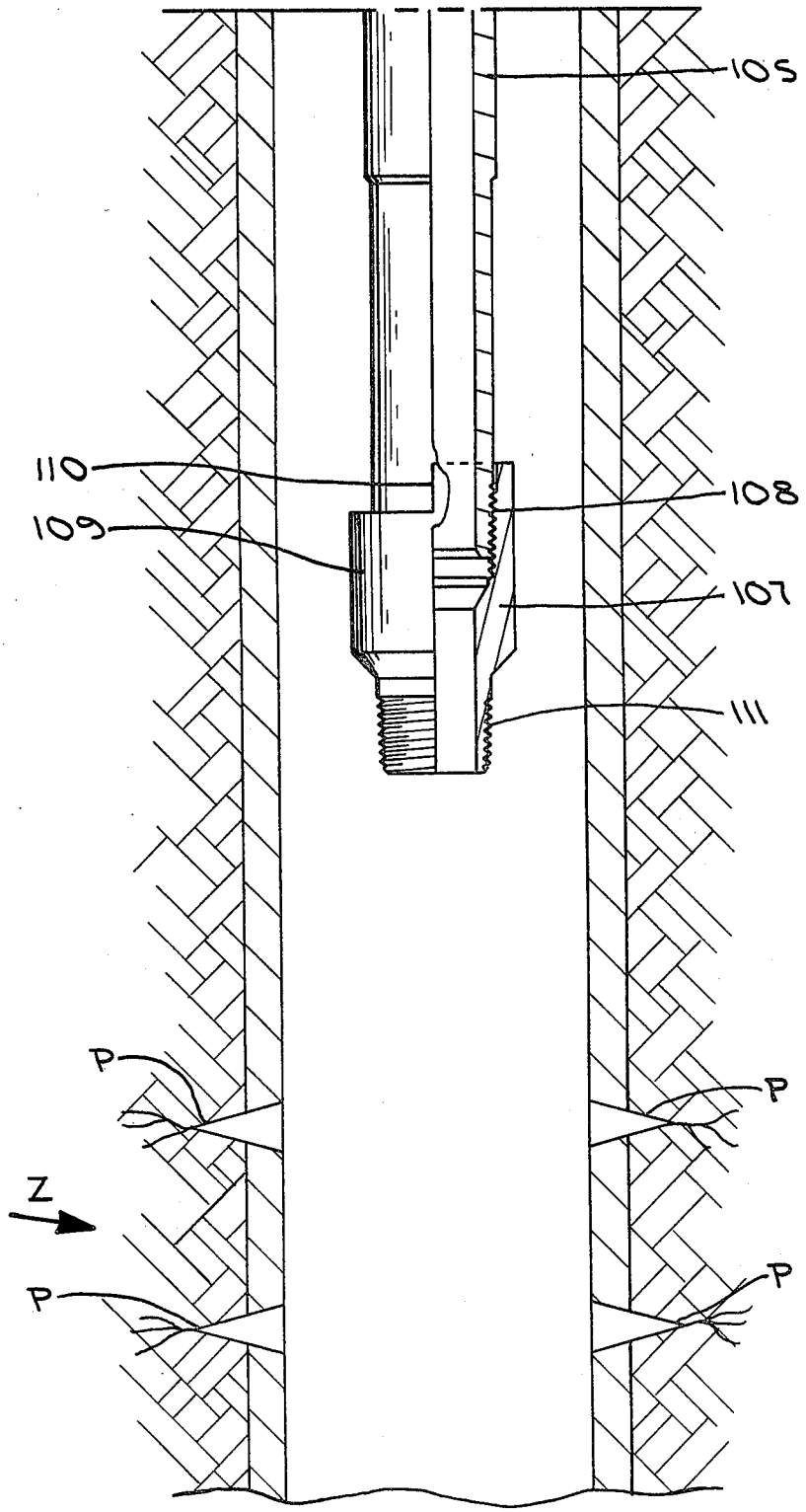

This disengaged position of the slick joint assembly 100 relative to the packer assembly 200, and the set position of the apparatus A now is as shown in FIGS. 2A, 2B and 2C.

As set forth above, the apparatus A will maintain its pressure integrity as long as the pressure defined by the interface of the interior wall of the casing C with the packing assembly 237 is higher than the differential pressure within the well defined across the packing assembly 237. As the apparatus A is set, mechanical manipulation induces the packing-to-casing setting pressure. This pressure generally is sufficient to hold a given amount of pressure differential across the packing assembly 237 such that the components in the packing elements 237, such as the non-elastomer packer element 239, will deteriorate, somewhat, by fracture, extrusion or compressive failure before the packing-to-casing seal is lost. Because of the construction of the apparatus A, the internal diameter of the casing may be increased somewhat as the tool is being set and checked to assure a sufficient packer-to-casing seal. As the seal pressure increases, the internal diameter of the casing also increases, somewhat correspondingly. Additionally, as each of the teeth 219 and 247A of the upper and lower slip assemblies, respectively, grip the inner wall of the casing C, the component parts of the apparatus A elongate due to the tensile load applied by the pressure at the packer-to-casing interface, which has resisted pressure differential. As the space for the packing assembly 237 increases, the packer element 239 will tend to "relax" or try to return to the original position, thereby reducing the contact pressure at the packer-casing interface. When this packer-casing interface pressure is reduced below the differential pressure which it is attempting to hold, differential pressure holding capability will be lost. Accordingly, the constant energizing feature of the present invention permits the pressure differential always to act upon the packing assembly 237 to assure the sufficient packer-casing pressure to withhold differential pressure up to the point of extrusion failure of the packing elements themselves.

It should be noted that after the packing assembly 237 has been sealingly secured against the inner wall of the casing C, there is an effective differential pressure area P-2 at the packing assembly 237 which is defined as the inner diameter of the non-elastomer packer element 239 and the outer diameter of the slick joint 105, which is sensitive to the pressure differential from above to below or from below to above the packing assembly 237. When the pressure differential is from above to below the assembly 237, the magnitude of the differential pressure multiplied by the area P-2 will be transmitted through the body lock ring 232 to the upper gauge ring 234 and, thence, upon the packing assembly 237. This differential pressure will transmit an axial load on the packing assembly 237 which is transmitted thereto by downward urging of the body 210, such downward urging being transmitted to the packing assembly 237 through the body lock ring 232, the lock ring retainer 228, and, finally, to the gauge ring 234, to boost the packing assembly 237 in the packed off position. It should be noted that the belleville springs 233 will maintain a setting force against the upper slip assembly 212. Also, differential pressure area P-1 directly loads the packing assembly 237.

Since the apparatus A is self-energizing when differential pressure is as above-described, the differential pressure will have a tendency to move the apparatus A further down the hole within the casing C, but that the motion is resisted by the engagement in the casing C of the teeth 247A of the slips 247. The high pressure above the apparatus A acting on the differential pressure area P-2 causes the body 210 to be urged down, compressing the packing assembly 237, resulting in continued interengagement between the lower slips 247 and the lower cones 245. This differential pressure, multiplied by the area P-2, results in a compressive load on the packing assembly 237 sufficient that the packer element 239 is able to resist the pressure acting on them at the area P-1.

If pressure below the assembly A is higher than that thereabove, this differential pressure will act upon areas P-1 and P-2 to urge the apparatus A upwardly. However, this upward movement is resisted by the interengagement of the teeth 219 into the inner wall of the casing C. The force created by this differential pressure acting on the area defined as P-1 is transferred through the packing assembly 237 to act upon the gauge ring 236, to urge it upwardly. Now, upward urging of the gauge ring 236, again, causes the upper cone 223 to be continued to be engaged onto the teeth 219 at the 222–224 interface. Additionally, upward movement of the body 210 caused by the differential pressure acting on area P-2 is transmitted to the packing assembly 237 by means of the releasing latch 255, to the release latch housing 254, thence into the lower slip ring 250, and, finally, to the lower cone 245, which transfers the upward urging force directly into the packing assembly 237.

It should be noted that any axial deformation of the parts of the apparatus A subjected to tension or compression loading, in the act of resisting the forces created by the differential pressure acting on areas P-1 and P-2 tend to increase the allowable volume of the packing assembly 237. Also, the further engagement of the teeth and the slips into the inner wall of the casing, and the increase in the casing inner diameter due to the increased pressure, both tend to increase the allowable volume of the packing assembly 237. As described above, if the allowable volume of the packing assembly 237 is allowed to increase sufficiently, the packer element 239 will relax and will not contain the pressure differential across the apparatus A. For this reason, differential area P-2 has been provided. The differential pressure acting on area P-2 causes the body 210 to be urged either upwardly, or downwardly, and create a compressive force on the packing assembly 237, as described above, which is sufficient to maintain the packing assembly in a packed off condition with the inner wall of the casing C, regardless of the direction of high pressure defining the differential pressure.

RETRIEVAL OF THE APPARATUS

In order to retrieve the apparatus A subsequent to setting within the well W, the tubing string TS is picked up and may be rotated to either the left or to the right, somewhat, in order to effect proper alignment of the upper clutch profile 258B and the lower clutch profile 109. Now, tension is applied through the tubing strings TS, the tension being transmitted from the slick joint 105 through the bottom clutch member 107 to the shear ring sleeve 258. As the shear strength of the shear ring 257 is overcome, the ring shears and permits the shear ring sleeve 258 to shift longitudinally upwardly with the clutch member 107 and the slick joint 105, relative to the longitudinally locked position of the shear ring retainer 256, the release latch housing 254, and interconnected parts thereof. The upper end of the shear ring sleeve 258 will contact the lower end 210A of the body 210, thus shifting the abutment 258A which has held the release latch 255 in place on the release latch housing 254, to within the releasing latch 255, such that the releasing latch 255 may contract inwardly away from the latch housing shoulder 254A. Now, the releasing latch 255 will travel upwardly with the shear ring sleeve 258, together with the body 210, until such time as the end 255A of the releasing latch 255 abuts upon the lower end 243A of the limit sleeve 243.

As the releasing latch 255 travels upwardly with the body 210, it should be noted that the pickup ring 231 on the body 210 has moved upwardly a comparative distance relative to the cone support ring 226 until such time as it abuts the ring 226. The tension applied through the tubing string TS now is transmitted through the pickup ring 231 to the cone support ring 226 and into the shear pin 225 until such time as the shear strength of the pin 225 is overcome. The cone support ring 226 will become disengaged from the upper cones 223, thus enabling the cones 223 to contract inwardly, such that the guide surface 224 does not contact the profile 222 of the upper slips 218, thus permitting the slips 218 to "rock" on the slip retaining ring 221A, and enabling the teeth 219 to become disengaged from within the inner wall of the casing C. Now, both the upper and lower slip elements are disengaged from within the casing C and the compressive force defined on the packing assembly 237 has been removed, permitting retrieval of the apparatus A from within the well W as the tubing string TS is picked up.

EMERGENCY RELEASE OF SLICK JOINT ASSEMBLY

Figure 5:
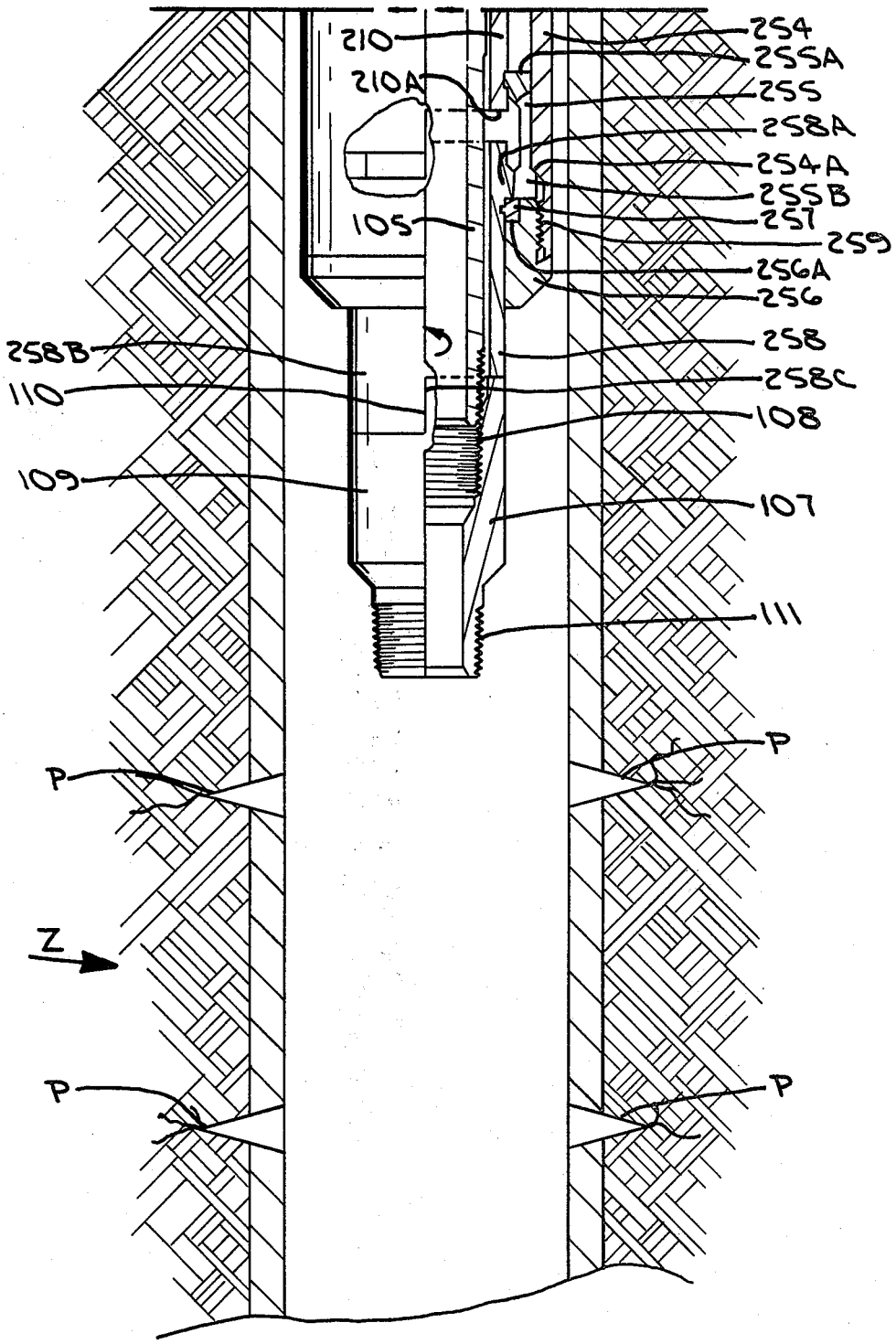
FIG. 5 is a view similar to that of FIG. 4C, illustrating the emergency rotational release feature, with the threads being disengaged between a bottom clutch member amd the slick joint.
Figure 6A:
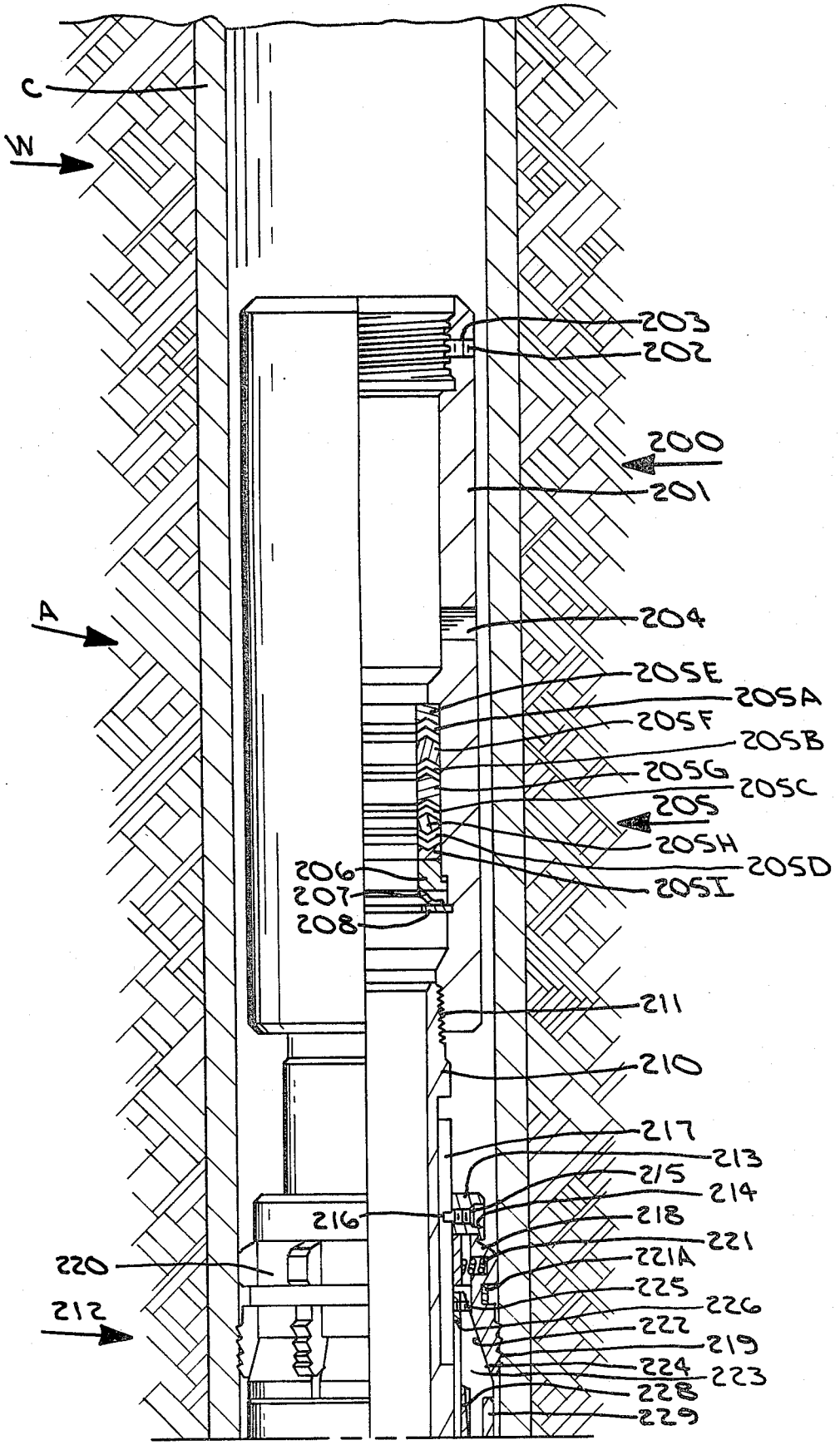
FIGS. 6A and 6B together constitute a longitudinally extending sectional view of the packer apparatus of the present invention subsequent to retrieval from the interior thereof of the slick joint, after utilization of the emergency release feature.
Figure 6B:
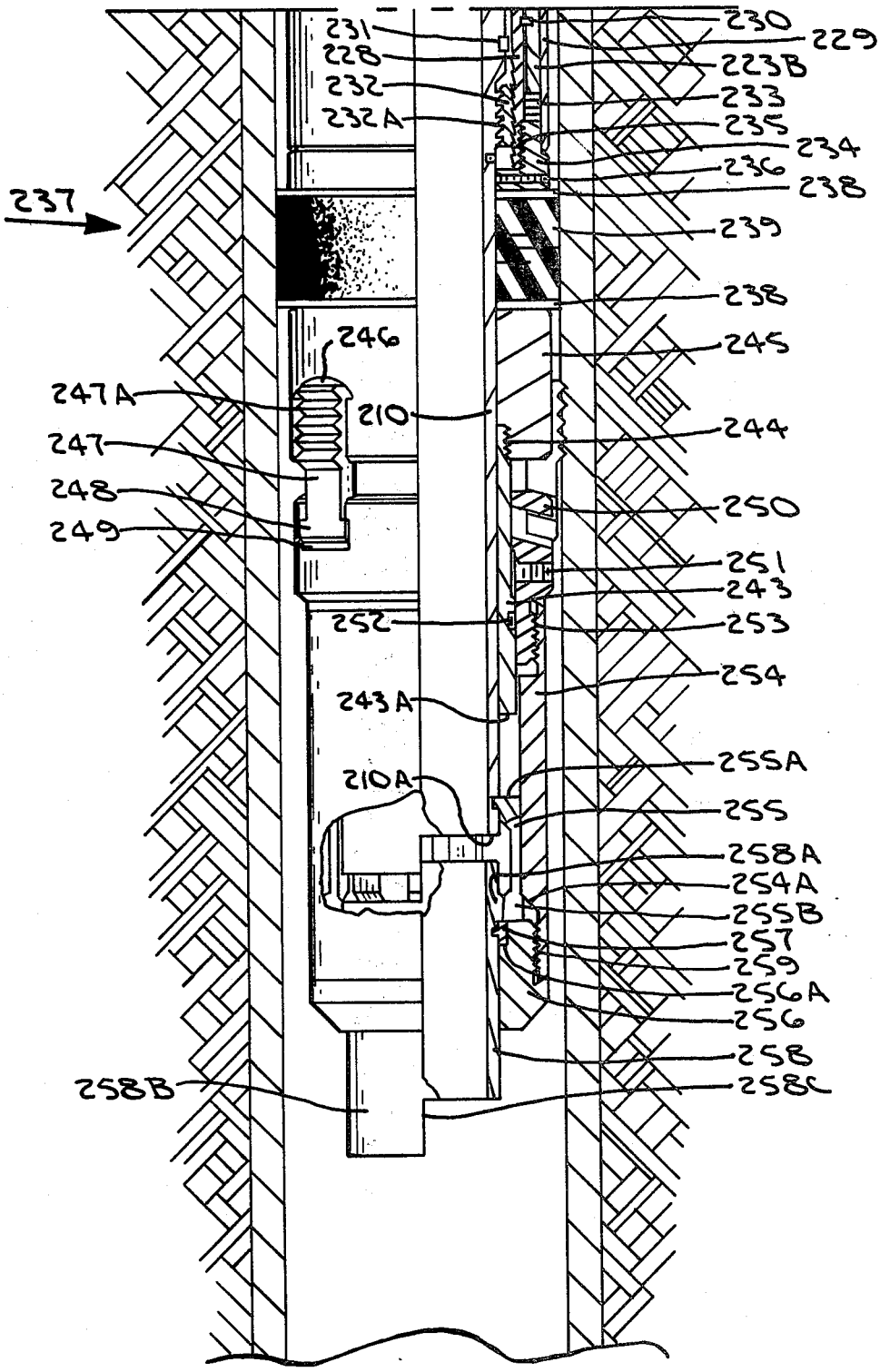

In the event that it is desired to release the slick joint assembly 100 from the packer assembly 200, maintaining the packer assembly 200 in sealed and anchored position relative to the inner wall of the casing C, the tubing string TS is picked up and rotated, slightly, to interengage the clutch 258C with the lower clutch element 110 such that the profiles 258B-109 are interengaged. Now, the tubing strings TS is rotated in a second direction, preferably to the right, such that the bottom clutch member 107 is released from the slick joint 105 at the emergency release threads 108, as shown in FIG. 5. When the bottom clutch member 107 is completely disengaged from the slick joint 105, the slick joint 105 may be completely manipulated through the packer assembly 200, leaving the packer assembly 200 completely intact in the well W, as shown in FIGS. 6A and 6B.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A tension-set retrievable packer apparatus adapted for use in a subterranean well within a first conduit therein, and connectable to a second conduit for running and setting within said well by application of tension through said second conduit, comprising: an elongated body securable to said second conduit; resiliently deformable packing means on said elongated body and movable into sealing engagement with said first conduit in response to longitudinal manipulation of said body by application of tension through said second conduit; slip means on said elongated body for expanding into gripping engagement with said first conduit upon manipulation of said elongated body, thereby placing said apparatus into anchored position in said well; expander means for expanding said slip means; a control body operably extending to said slip and expander means; releasing means operably extending from said expander means; latch means for initially securing said control body with said releasing means during running and setting, and selectively shiftable to disengage said control body and said releasing means for retrieval of said apparatus; and lock sleeve means operably communicating with said releasing means for securing said latch means and one of said control body and said releasing means and shearably releasable therefrom for disengagement of said control body and said releasing means, the application of tension through said second conduit being carried by said control body without being transmitted through said lock sleeve means to shift said slip means into anchored position and drive said packing means into sealing relation with said first conduit.

2. The apparatus of claim 1 further comprising: a tubular member securable to said second conduit and telescopically manipulative relative to said elongated body; means forming a seal between said elongated body and said tubular member; means connecting said tubular member to said body and releasable by manipulation of said second conduit for enabling telescopic movement between said elongated body and said tubular member; and coengageable clutch members on said tubular member and said lock sleeve means movable into engaged position upon manipulation of said second conduit to shift said lock sleeve means into shearably disengaged position relative to said release housing for retrieval of said apparatus.

3. The apparatus of claim 1 further comprising: a tubular member securable to said second conduit and telescopically manipulatable relative to said elongated body; means forming a seal between said elongated body and said tubular member; and means connecting said tubular member to said body and releasable by manipulation of said second conduit for enabling telescopic movement between said elongated body and said tubular member.

4. The apparatus of claim 2 further comprising coengageable clutch members on said tubular member and said lock sleeve means movable into engaged position upon manipulation of said second conduit to shift said lock sleeve means into shearably disengaged position relative to said releasing means for retrieval of said apparatus.

5. A tension-set retrievable, constantly energized, no-load packer apparatus adapted for use in a subterranean well within a first conduit therein, and connectable to a second conduit for running and setting within said well by application of tension through said second conduit, comprising: an elongated body securable to said second conduit; resiliently deformable packing means on said elongated body and movable into sealing engagement with said first conduit in response to longitudinal manipulation of said body by application of tension through said second conduit; upper and lower normally retracted slip means on said elongated body expandable into gripping engagement with said first conduit upon manipulation of said elongated body, thereby placing said apparatus into anchored position in said well; upper and lower expansion means for expanding said upper and lower slip means, respectively, said packing means being disposed between said upper and lower slip and expansion means, said slip means resisting upper and lower longitudinal movement of said apparatus when in gripping engagement with said first conduit; a control body operably extending to said upper and lower slip and expander means and encircled by said packing means; a release housing operably extending from said lower expansion means; latch means for initially securing said control body with said release housing during running and setting, and selectively shiftable to disengage said control body and said release housing for retrieval of said apparatus; lock sleeve means operably communicating to said release housing for securing said latch means and one of said control body and said release housing and shearably releasable therefrom for disengagement of said control body and said release housing, the application of tension through said second conduit being carried by said control body without being transmitted through said lock sleeve means to shift said upper and lower slip means into anchored position and drive said packing means into sealing relation with said first conduit.

6. The apparatus of claim 5 further comprising: a tubular member securable to said second conduit and telescopically manipulatable relative to said elongated body; means forming a seal between said elongated body and said tubular member; and means connecting said tubular member to said body and releasable by manipulation of said second conduit for enabling telescopic movement between said elongated body and said tubular member.

7. The apparatus of claim 6 further comprising coengageable clutch members on said tubular member and said lock sleeve means movable into engaged position upon manipulation of said second conduit to shift said lock sleeve means into shearably disengaged position relative to said releasing means for retrieval of said apparatus.

8. The apparatus of claim 1, 2, 5 or 6 further comprising effective pressure area means for transmitting to the packing means the compressive force resulting from a differential pressure across said packing means when said slip means are in expanded position and said packing means are sealed relative to said first conduit whereby said packing means are constantly energized and maintained in sealing relationship with said first conduit.

9. The apparatus of claim 1, 2, 5 or 6 further comprising one-way locking means enabling longitudinal movement of said control body in a first direction and for holding said control body shifted with said packing means deformed and said slip means engaged with said first conduit.

10. The apparatus of claim 1, 2, 5 or 6 further comprising one-way locking means enabling longitudinal movement of said control body in a first direction and for holding said control body shifted with said packing means deformed and said slip means engaged with said first conduit, said locking means being between said control body and said upper expander means.

11. The apparatus of claim 1, 2, 5 or 6 further comprising control means releasably connecting at least one of said upper slip means and said upper expander means to said elongated body and enabling expansion of said upper and lower slip means by said upper and lower expander means in response to longitudinal movement of said elongated body following release of said control means.

12. The apparatus of claim 1, 2, 5 or 6 further comprising control means releasably connecting at least one of said upper slip means and said upper expander means to said elongated body and enabling expansion of said upper and lower slip means by said upper and lower expander means in response to longitudinal movement of said elongated body following release of said control means, said control means comprising a slotted member defined on said control body and a control pin extending from one of said upper slip means for relative movement within said slotted member upon manipulation of said second conduit.

13. The apparatus of claim 1 or 6 further comprising: a tubular member securable to said second conduit and telescopically manipulatable relative to said elongated body; means forming a seal between said elongated body and said tubular member; means connecting said tubular member to said body and releasable by manipulation of said second conduit for enabling telescopic movement between said elongated body and said tubular member; an abutment on the lower end of said tubular member; and means connecting said abutment on said tubular member and releasable to enable removal of said tubular member from said apparatus for retrieval of said tubular member out of said apparatus while said apparatus remains in anchored position in said well.

14. The apparatus of claim 1, 2, 5 or 6 further comprising biasing means for transmitting a supplemental anchorably urging load through at least one of said expansion means into at least one of said slip means.

15. The apparatus of claim 1, 2, 5 or 6 further comprising biasing means for transmitting a supplemental anchorably urging load through at least one of said expansion means into at least one of said slip means, said biasing means comprising a series of belleville springs compressibly loadable by shifting of said control body and housed within said elongated body exteriorly of said control body.

16. A tension-set retrievable packer apparatus adapted for use in a subterranean well within a first conduit therein, and connectable to a second conduit for running and setting within said well by application of tension through said second conduit, comprising: an elongated body securable to said second conduit; resiliently deformable packing means on said elongated body and movable into sealing engagement with said first conduit in response to longitudinal manipulation of said body by application of tension through said second conduit; slip means on said elongated body for expanding into gripping engagement with said first conduit upon manipulation of said elongated body, thereby placing said apparatus into anchored position in said well; expander means for expanding said slip means; a control body operably extending to said slip and expander means; releasing means operably extending from said expander means; latch means for initially securing said control body with said releasing means during running and setting, and selectively shiftable to disengage said control body and said releasing means for retrieval of said apparatus; lock sleeve means operably communicating with said releasing means for securing said latch means and one of said control body and said releasing means and shearably releasable therefrom for disengagement of said control body and said releasing means, the application of tension through said second conduit being carried by said control body without being transmitted through said lock sleeve means to shift said slip means into anchored position and drive said packing means into sealing relation with said first conduit; and biasing means for transmitting a supplemental anchorably urging load through said expander means into said slip means.

17. The apparatus of claim 16: said biasing means comprising a series of belleville springs compressibly loadable by shifting of said control body and housing within said elongated body exteriorly of said control body.

* * * * *